United States Patent [19]

King

[11] 4,133,328

[45] Jan. 9, 1979

[54] PROPORTIONAL FUEL VAPOR PURGE FLOW CONTROL APPARATUS

[75] Inventor: Jack B. King, Royal Oak, Mich.

[73] Assignee: General Motors Corporation, Detroit, Mich.

[21] Appl. No.: 812,444

[22] Filed: Jul. 5, 1977

[51] Int. Cl.[2] ..... F02M 59/00

[52] U.S. Cl. ..... 123/136

[58] Field of Search ..... 123/136

[56] References Cited

U.S. PATENT DOCUMENTS

| | | | |
|---|---|---|---|
| 3,752,134 | 8/1973 | Hollis | 123/136 |
| 3,913,545 | 10/1975 | Haase et al. | 123/136 |

*Primary Examiner*—Ronald B. Cox
*Attorney, Agent, or Firm*—Arthur N. Krein

[57] ABSTRACT

In a fuel vapor recovery system for an internal combustion engine, a proportional fuel vapor purge flow control apparatus is used to regulate the flow of a fuel vapor-air mixture to the induction system of the engine, the flow control apparatus including a variable area flow control valve which is diaphragm operated by exhaust back pressure to provide a canister purge flow area which is proportional to exhaust back pressure and a vacuum regulator operative to provide a constant pressure differential across the variable area valve.

3 Claims, 2 Drawing Figures

PROPORTIONAL FUEL VAPOR PURGE FLOW CONTROL APPARATUS

Figure 1:
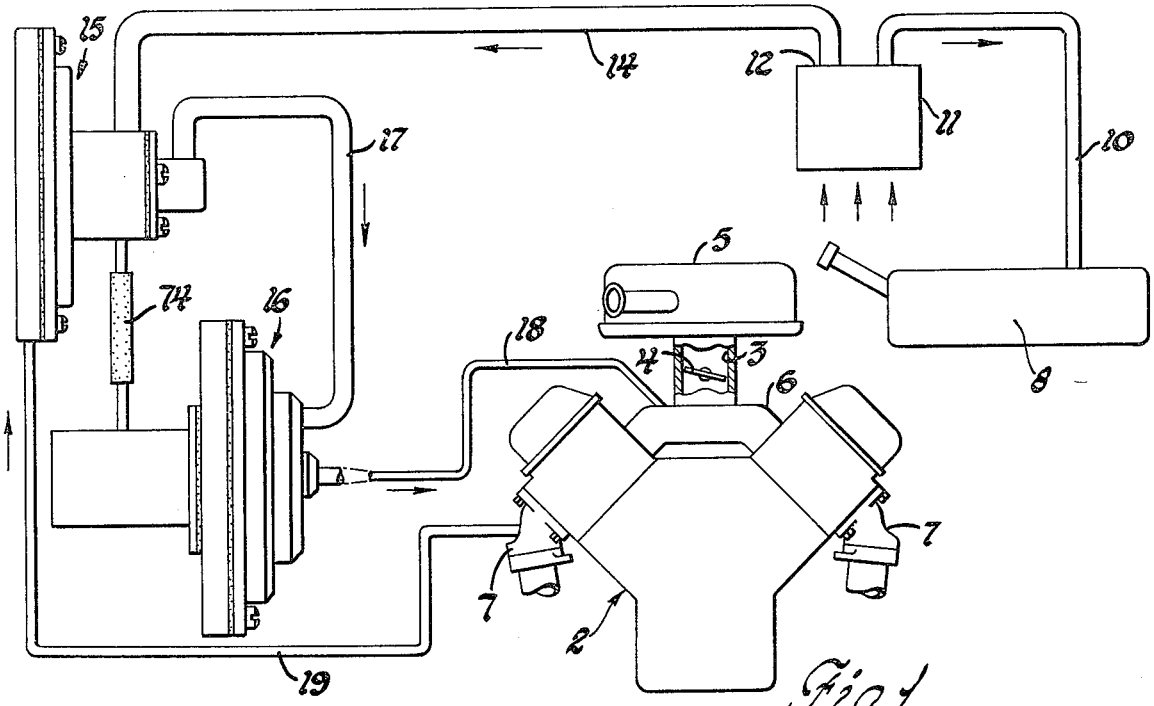

This invention relates to a fuel vapor recovery system, also called an evaporative emission control system, for an internal combustion engine and, in particular, to a proportional fuel vapor purge flow control apparatus for use in such a fuel vapor recovery system.

In those fuel vapor recovery systems wherein a fuel vapor storage canister is purged by the use of engine intake manifold vacuum, the use of such intake manifold vacuum causes most of the purge flow to occur at low engine speeds and loads. At higher engine speeds and loads, when the engine is capable of consuming larger quantities of the vapor-air mixture from the canister, the fuel vapor purge rate decreases. On the other hand, in those fuel vapor recovery systems wherein fuel vapor canister purge is obtained by utilizing the pressure drop across the engine inlet air filter or silencer, the use of such a pressure drop, although providing proportional fuel vapor purge rates, results in flow rates that are quite low due to the small pressure differential available at the engine inlet air filter or silencer.

Recent changes in the Federal evaporative emission test procedure now allow less pre-conditioning of the fuel vapor storage canister. This change in the test procedure has the effect of reducing vapor storage capacity. At the same time, the allowable exhaust emission levels are being reduced. Accordingly, it will now be necessary to increase the fuel vapor purge flow rate for an engine to meet these new standards, but increasing the fuel vapor purge flow rate of any of the known fuel vapor purge methods described above would tend to increase the interactive effect on exhaust emissions.

Accordingly, it is the principal object of this invention to provide an improved fuel vapor purge flow control apparatus whereby the purge flow of fuel vapor will be proportional to engine exhaust flow, the apparatus utilizing engine intake vacuum as the motive force to effect this purging.

Another object of this invention is to improve a fuel vapor recovery system for an internal combustion engine whereby a proportional fuel vapor purge flow control apparatus is used to effect a purge flow rate of fuel vapors which is proportional to the induction flow through the engine.

These and other objects of the invention are obtained in a vapor recovery system for an internal combustion engine having an induction passage with a throttle valve controlling induction flow therethrough, an exhaust system providing a flow path for exhaust gases discharged from the engine and a fuel system for the engine including a fuel vapor canister with a fuel vapor-air outlet, by the use of a proportional fuel vapor purge flow control apparatus that includes a variable area flow control valve having an inlet connected to the fuel vapor-air mixture outlet of the canister, an outlet and an orifice passage therebetween, the control valve further having an exhaust pressure actuated diaphragm operated valve positioned relative to the orifice passage to vary the flow area therethrough as a function of exhaust gas pressure in the exhaust system of the engine and, a vacuum regulator valve having an inlet connected to the outlet of the variable area flow control valve and an outlet connected to the induction passage of the engine downstream of the throttle valve, a flow aperture positioned between the inlet and outlet of the vacuum regulator valve, the vacuum regulator valve further including a diaphragm actuated valve normally biased to a fully open position relative to the flow aperture of this valve, the valve being operative so as to be progressively closed in opposition to the bias by an increase in induction vacuum and, passage means interconnecting the inlet of the variable area flow control valve and the side of the diaphragm actuated valve on the side thereof opposite the outlet side of this valve.

Figure 2:
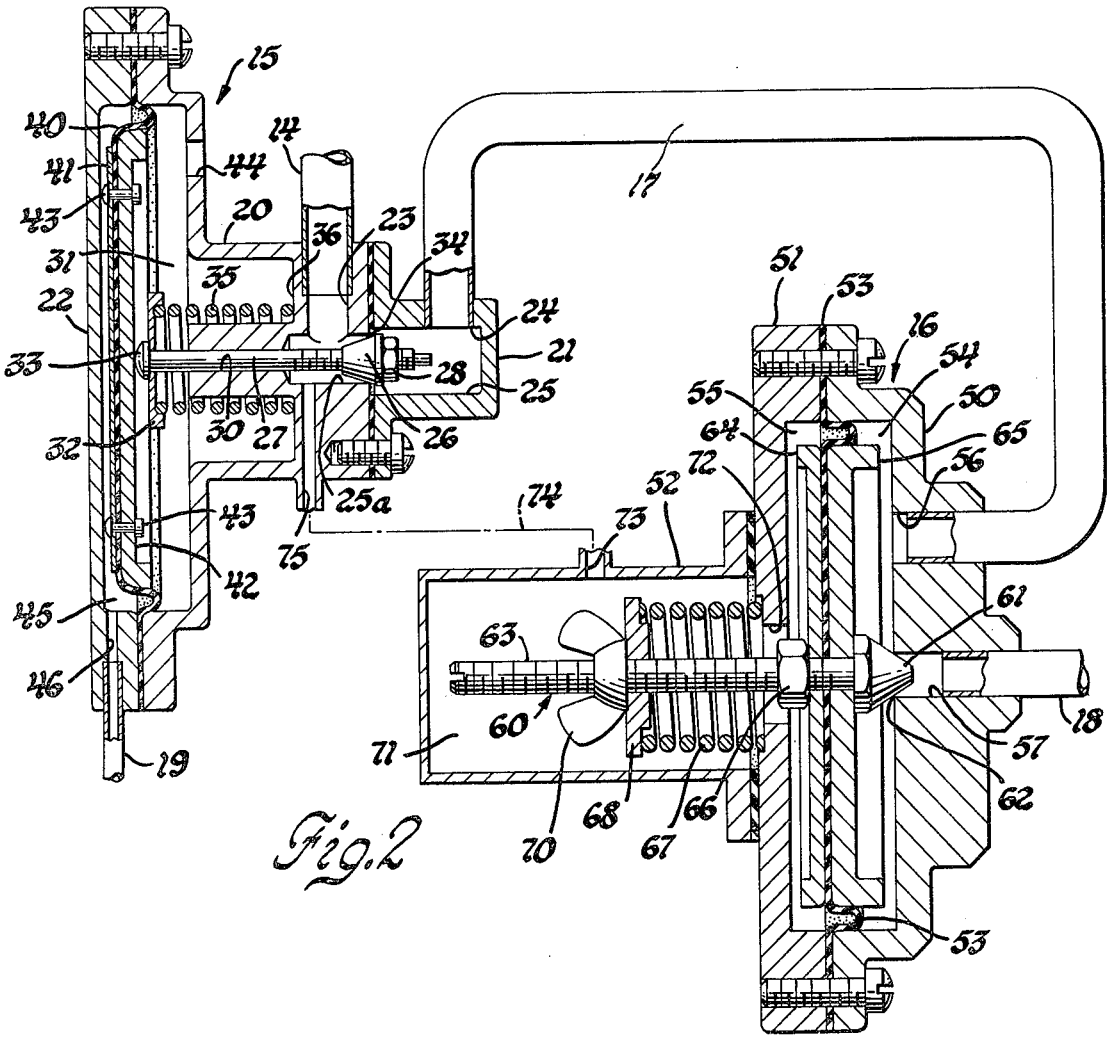

For a better understanding of the invention, as well as other objects and further features thereof, reference is had to the following detailed description of the invention to be read in connection with the accompanying drawings, wherein:

FIG. 1 is a schematic view of an internal combustion engine and of a fuel vapor recovery system for the engine, the fuel vapor recovery system having a proportional fuel vapor purge flow control apparatus, in accordance with the invention, incorporated therein; and, FIG. 2 is an enlarged sectional view of the proportional fuel vapor purge flow control apparatus of FIG. 1.

Referring first to FIG. 1, an internal combustion engine 2 has an induction system including a carburetor having an induction passage 3 therethrough with flow through the induction passage controlled by a throttle valve 4 and with an air cleaner 5 mounted on the carburetor. Induction fluid flowing through the induction passage 3 is delivered to an intake manifold 6 for supplying induction fluid to the combustion chambers, not shown, of the engine. Exhaust manifold 7 forms part of an exhaust system providing a flow path for the exhaust gases discharged from the combustion chambers of the engine. A supply of fuel, such as gasoline, for the engine 2 is contained in a fuel reservoir 8, from which liquid fuel is delivered through a suitable conduit and fuel supply system, not shown, to the engine.

As part of a fuel vapor recovery system for the engine, a conduit 10 is connected at one end to the fuel tank 8 in position to receive fuel vapor from the tank and at its other end the conduit 10 is connected to a conventional fuel vapor canister, such as a carbon canister 11, for the storage of fuel vapor. As is conventional, such a canister 11 is provided at one end with a suitable inlet for the flow of atmospheric air, as shown by the directional arrows, into the canister and, the canister is also provided with an outlet 12 for a vapor-air mixture discharged from the canister.

Fuel vapor and air from the canister 11 is delivered via a conduit 14, connected at one end to the outlet 12 of the canister, to a proportional fuel vapor purge control apparatus, in accordance with the invention, which includes a variable area flow control valve, generally designated 15, and a vacuum regulator valve, generally designated 16, connected in series, whereby the vapor-air mixture can be delivered to the induction system of the engine for consumption therein. As shown, the variable area flow control valve 15 has an inlet connected to the opposite end of the conduit 14 and, an outlet which, in the construction illustrated, is connected by a conduit 17 to the inlet of the vacuum regulator valve 16, while the outlet of the vacuum regulator valve 16 is connected by a suitable conduit 18 in flow communication with the induction passage for the engine downstream of the throttle valve 4. To effect flow of the vapor-air mixture in proportion to the flow of induction fluid through the engine, the variable area flow control valve 15 is a diaphragm operated valve, to be described in detail hereinafter, which is actuated by engine exhaust pressure whereby to vary the flow of the vapor-air mixture through control valve 15 as a function of exhaust gas pressure in the exhaust system. To effect this, a conduit 19 is connected at one end to the exhaust system, as by being connected to an exhaust manifold 7, and at its other end is connected to the variable area flow control valve 15 in a manner to be described in detail hereinafter.

Referring now to FIG. 2, the variable area flow control valve 15, of the subject flow control apparatus, in the construction illustrated, includes a valve body or housing consisting, in the embodiment illustrated, of a main body 20, a cover 21 and a base 22 suitably secured together to form a unitary structure. The housing thus formed is provided with an inlet 23, connected to the conduit 14 extending from the canister 11, an outlet 24, connected to one end of the conduit 17 and with a passage 25, including an orifice passage **25*a* therein, interconnecting the inlet 23 to the outlet 24. Flow through the orifice passage 25*a* is controlled by a tapered valve member 26 threadingly secured on the threaded end of a valve stem 27 and fixed axially thereon, as by a lock nut 28, also threadingly engaged on the threaded end of the valve stem 27. The tapered valve member 26 is properly sized and profiled so that the flow area through the orifice passage 25*a*, as controlled by this valve member, changes linearly with valve member 26** travel.

The valve stem 27 is slidably received in a valve stem guide bore 30 provided in an internal boss of the main body 20, concentric with the orifice passage **25*a*. As shown, the valve stem 27 extends through the valve stem guide bore 30 into a chamber 31, provided by the main body 20, to receive a centrally apertured cup-like spring retainer 32 that is fixed against axial movement in one direction on the valve stem 27 as by engagement with an enlarged head 33 provided on one end of the valve stem 27. The valve member 26 is normally biased into seating engagement with a valve seat 34 encircling the orifice passage 25*a* by means of a coiled spring 35 having a linear load rate that encircles the valve stem 27 and the boss of the main body 20 of the housing through which the valve stem guide bore 30 extends, with the spring 35 positioned to abut at one end against the spring retainer 32 and at its other end against an internal wall 36 of the main body 20**.

A diaphragm assembly, including a diaphragm 40 and opposed support plates 41 and 42, suitably secured together as by rivets 43, defines with the main body 20 the chamber 31 that is in communication with the atmosphere as by one or more apertures 44 extending through a side wall of the main body 20. This diaphragm assembly defines, with the base 22, an exhaust pressure chamber 45 that is placed in communication, via a passage 46 in base 22 and the conduit 19, with the exhaust flow path of exhaust gases discharged from the engine in the manner described. As illustrated, the spring 35 biasing the tapered valve member 26 into seating engagement with the valve seat 34 will normally also bias the enlarged head 33 on the valve stem 27 into a position for abutment against the diaphragm support plate 42 of the diaphragm assembly.

With this arrangement, during engine operation, the exhaust gas back pressure of the exhaust gases flowing through the exhaust system of the engine 2 will be applied to the exhaust pressure chamber 45 and thus to one side of the constant area diaphragm assembly of the variable area flow control valve 15 facing this chamber to effect movement of the valve member 26, in an opening direction relative to the valve seat 34 against the biasing action of spring 35, whereby to vary the effective flow area through the orifice passage **25*a* of control valve 15** as a function of exhaust flow from the engine.

This exhaust flow, as is well known, is directly proportional to the flow of induction fluid through the engine. Further, the back pressure created in the exhaust passages, such an in exhaust manifold 7, of an internal combustion engine, is generally proportional to the square of the rate of induction fluid flow through the engine induction passages. Thus, the rate of flow of exhaust gases from an exhaust passage, such as exhaust manifold 7, is generally proportional to the square root of the exhaust back pressure and, accordingly, the rate at which exhaust gases are discharged from the engine 2 is generally proportional to the rate at which induction fluid flows through the engine. The flow area of the engine exhaust system is a constant value and the exhaust back pressure is proportional to the square of the exhaust flow. The purge flow through the variable area valve is proportional to exhaust flow because the variable area is a linear function of the exhaust back pressure and the pressure drop across it is a constant value.

Since engine intake manifold vacuum is not constant, but varies inversely with engine load, the flow control apparatus of the subject invention has also incorporated therein the vacuum regulating valve 16 to maintain substantially a constant pressure differential across the variable flow area of the control valve 15.

The vacuum regulator valve 16, in the construction illustrated, includes a valve body having a base 50, an intermediate body 51 and a cup-shaped cover 52 suitably secured together to form a unitary valve body structure. A diaphragm 53 secured between the base 50 and the intermediate body 51 forms with the base 50 a fluid flow chamber 54 and divides this chamber 54 from a chamber 55 that is located on the opposite side of the diaphragm 53 as provided by the diaphragm 53 cooperating with the intermediate body 51. The base 50 is provided with an inlet 56 to the chamber 54 that is connected to the opposite end of conduit 17 for communication with the outlet 24 of the variable area flow control valve 15. Fluid flow out of the chamber 54 is via a centrally located through passage or outlet 57 that is connected by the conduit 18 to the induction system of the engine 2 downstream of the throttle valve 4.

Flow through the outlet 57 is controlled by a regulator valve or valve 60. In the construction shown, the valve 60 is provided with a cone-shaped enlarged valve head 61, adapted to extend into the outlet 57 and seat against a valve seat 62 encircling into the outlet 57, and with a threaded valve stem 63 extending from head 61. A pair of diaphragm support plates 64 and 65 are positioned on opposite sides of the diaphragm 53 and are secured thereto, as by having the threaded valve stem 63 extending through a suitable aperture in each of these plates and through the diaphragm 53, with this assembly then being sandwiched between the valve head 61 and a nut 66 threaded on the valve stem 63. The valve head 61 is normally biased in an open direction, effecting unseating of the valve head 61 from the valve seat 62, by means of a coiled spring 67 encircling the valve stem within the cover 52, one end of the spring 67 abutting against a surface of the intermediate body 51 and the opposite end thereof abutting against an apertured spring retainer 68 loosely encircling the valve stem 63 and which is adjustably axially retained against movement in one direction relative to the valve stem 63 by means of a wing nut 70 threaded onto the threaded valve stem 63.

In the construction shown, the cup-shaped cover 52 forms, with the intermediate body 51, a chamber 71 that is in communication with the chamber 55 via a central aperture 72 in the intermediate body 51, coaxial with outlet 57, and through which the valve stem 63 loosely extends. The chamber 55, which may be described as a pressure regulator chamber on the side of the diaphragm 53 opposite outlet 57 is subjected to the pressure of the vapor-air mixture on the upstream side of the flow control valve 15 as by having a passage 73, in the cover 52 opening into the chamber 71, connected by a suitable conduit 74 to a passage 75, in the main body 20 of the flow control valve 15, which opens into a portion of the passage 25 on the upstream side of this passage relative to flow through the orifice passage 25*a* as controlled by valve member 26.

In operation, the valve 60 is biased to the open position relative to the valve seat 62 of outlet 57 by the coiled spring 67 and it is moved toward the closed position by the application of manifold vacuum to one side of the diaphragm 53, that is, to the side of this diaphragm exposed to the chamber 54. The level of regulated vacuum is determined by the preselected force of the spring 67. Variations in engine manifold vacuum and the vapor-air mixture flow rate, which tend to change the regulated vacuum level, are compensated for by a re-positioning of the regulator valve 60. The spring 67 is designed to have a small predetermined load change rate. Any pressure drop which occurs across canister 11 upstream of the flow control valve 15, specifically upstream of valve member 26, is applied via the passages 73, 75 and conduit 74 to the spring side of the diaphragm 53, in the manner previously described, so that the regulated vacuum will be increased by a like amount to thereby maintain a constant differential pressure across the flow control valve 15.

What is claimed is:

1. In a vapor recovery system for an internal combustion engine having an induction system with a throttle valve controlling flow therethrough, an exhaust system for discharged exhaust gases and a fuel reservoir means, a proportional purge flow apparatus including: a variable flow control valve including a housing having an inlet connectable to the fuel reservoir means for receiving fuel vapor discharged from the fuel reservoir means, an outlet and a passage including an aperture therebetween, a valve mechanism disposed in said housing and having a valve head positioned to variably control flow through said aperture and pressure means responsive to exhaust gas pressure in the exhaust system operatively connected to said valve mechanism to effect movement of said valve head in an opening direction relative to said aperture, a vacuum regulator valve including a valve housing means having an inlet means operatively connected to said outlet, an outlet means connectable to the induction system downstream of the throttle valve and a flow chamber means therebetween, a regulator valve mechanism disposed in said valve housing in position to regulate flow through said outlet means and vacuum pressure means responsive on one side to induction vacuum pressure downstream of the throttle valve operatively connected to said regulator valve mechanism to effect movement of said regulator valve mechanism in a closing direction relative to said outlet means with increases in induction vacuum pressure and, conduit means connected at one end to receive fuel vapor pressure upstream of said aperture relative to the direction of flow from said inlet to said outlet and connected to be in communication at its other end with the opposite side of said vacuum pressure means whereby said vacuum regulator valve is operative to regulate the vacuum at said inlet means to maintain a constant differential pressure across said variable flow control valve.

2. A purge flow control apparatus for use in the vapor recovery system for an internal combustion engine, the engine having an induction passage with a throttle valve controlling flow therethrough, an exhaust system providing a flow path for exhaust gases discharged from the engine and a fuel reservoir means for supplying fuel to the engine, said purge flow control apparatus including a variable flow control valve having a housing with an inlet connectable to the fuel reservoir means for receiving fuel vapor discharged from the fuel reservoir means, an oulet and a passage means including an orifice passage between said inlet and said outlet, a valve mechanism disposed in said housing and having a tapered valve element at one end thereof positioned to control flow through said orifice passage, spring means operatively connected to said valve element to normally bias said valve element into a closed position relative to said orifice passage, pressure means responsive to exhaust gas pressure in the exhaust system operatively connected to said valve mechanism to effect movement of said valve member in an opening direction relative to said orifice passage and, a vacuum regulator valve including a valve housing means providing a cavity therein, a diaphragm assembly fixed at its outer periphery to said housing to divide said cavity into a flow chamber on one side thereof and a pressure regulator chamber on the other side thereof, said valve housing having an inlet means to said flow chamber operatively connected to said outlet and an outlet means from said flow chamber connectable to the induction passage downstream of the throttle valve, a regulator valve means disposed in said valve housing in position to regulate flow from said flow chamber out through said outlet means and, conduit means operatively connecting said pressure regulator chamber to the fuel vapor pressure in said variable flow control valve on the upstream side thereof relative to the direction of flow of fuel vapor in said variable flow control valve from said inlet to said outlet, said diaphragm assembly being responsive to induction vacuum pressure on one side thereof to effect movement of said regulator valve mechanism in a closing direction relative to said outlet means with increases in induction vacuum pressure.

3. A proportional purge flow control apparatus for use in the vapor recovery system of an internal combustion engine, the engine having a fuel system including a fuel vapor canister with a fuel vapor outlet therefrom, an induction passage with a throttle valve controlling induction flow therethrough and an exhaust system providing a flow path for exhaust gases discharged from the engine, said proportional purge flow control apparatus, for controlling the recovery flow of fuel vapors from the fuel vapor canister to the induction passage, including a variable area flow control valve having an inlet connected to the fuel vapor outlet of the fuel vapor canister, an outlet and a passage means including an orifice passage therebetween, a pressure actuated diaphragm operated valve operatively positioned relative to said orifice passage to vary the flow area through said orifice passage linearly as a function of exhaust gas pressure in the exhaust system and, a vacuum regulator valve including a valve body having an inlet means connected to said outlet and an outlet means with a flow chamber between said inlet means and said outlet means, a regulator valve mechanism operatively positioned in said valve body relative to said outlet means to control the flow from said flow chamber out through said outlet means, spring means positioned to normally bias said regulator valve mechanism to a fully open position relative to said outlet means and, diaphragm means in said valve body dividing said flow chamber from a pressure regulator chamber provided by said diaphragm means and said valve body, said diaphragm means being operatively connected to said regulator valve mechanism, said diaphragm assembly being operative upon an increase in induction vacuum to progressively move said regulator valve mechanism in a direction to progressively move said regulator valve mechanism in a closing direction relative to said outlet means and, passage means operatively connecting said inlet of said variable area flow control valve to said pressure regulator chamber whereby said pressure regulator chamber is subjected to fuel vapor pressure on the upstream side of said orifice passage relative to the direction of flow from said inlet to said outlet.

* * * * *